US008011676B1

(12) United States Patent
Keast

(10) Patent No.: US 8,011,676 B1
(45) Date of Patent: Sep. 6, 2011

(54) SNOWBOARD ASSEMBLY

(76) Inventor: Michael Keast, Schoolcraft, MI (US)

( * ) Notice: Subject to any disclaimer, the term of this patent is extended or adjusted under 35 U.S.C. 154(b) by 266 days.

(21) Appl. No.: 12/407,121

(22) Filed: Mar. 19, 2009

(51) Int. Cl.
*A63C 5/03* (2006.01)
*A63C 5/04* (2006.01)

(52) U.S. Cl. ..... 280/14.22; 280/633; 280/634

(58) Field of Classification Search ..... 280/607, 280/617, 618, 633, 634, 14.21, 14.22, 14.24; 441/68, 74
See application file for complete search history.

(56) References Cited

U.S. PATENT DOCUMENTS

| | | | | |
|---|---|---|---|---|
| 3,785,666 | A * | 1/1974 | Pierre et al. | 280/633 |
| 4,871,337 | A | 10/1989 | Harris | |
| 5,035,443 | A * | 7/1991 | Kincheloe | 280/618 |
| 5,054,807 | A * | 10/1991 | Fauvet | 280/607 |
| 5,090,722 | A * | 2/1992 | Ritchie et al. | 280/607 |
| 5,344,179 | A | 9/1994 | Fritschi et al. | |
| 5,794,962 | A * | 8/1998 | Bardin et al. | 280/607 |
| 5,810,370 | A * | 9/1998 | Covert et al. | 280/14.24 |
| 6,062,584 | A | 5/2000 | Sabol | |
| 6,089,581 | A | 7/2000 | Partridge | |
| D446,836 | S | 8/2001 | Lee | |
| 6,491,310 | B1 | 12/2002 | Work | |
| D473,907 | S | 4/2003 | Eckert | |
| 6,666,471 | B2 | 12/2003 | Gatel | |
| 2002/0125687 | A1 * | 9/2002 | Jones et al. | 280/613 |
| 2005/0236785 | A1 * | 10/2005 | Poellmann | 280/14.22 |

FOREIGN PATENT DOCUMENTS

WO WO 98/37933 A1 * 9/1998

* cited by examiner

*Primary Examiner* — Ruth Ilan

(57) ABSTRACT

A snowboard assembly includes an elongated panel has a top side, a bottom side, a front end and a back end. One of foot engaging member is positioned nearer to the front end and one foot engaging member is positioned nearer to the back end. Each of the foot engaging members comprises a first rail and a second rail each attached to the top side. A plate is positioned on the top side and extends between and engages the first and second rails. The plate is selectively slidable along the first and second rails. A foot covering is couplable to the plate to releasably secure a person's foot to the plate. A resistance apparatus engages the plate to increase or decrease a frictional force between the first and second rails and the plate to selectively alter ease of movement of the relative to the first and second rails.

16 Claims, 7 Drawing Sheets

SNOWBOARD ASSEMBLY

BACKGROUND OF THE DISCLOSURE

1. Field of the Disclosure

The disclosure relates to snowboard devices and more particularly pertains to a new snowboard device for allowing a person to alter the position of their feet while actively using the snowboard.

2. Summary of the Disclosure

An embodiment of the disclosure meets the needs presented above by generally comprising an elongated panel has a top side, a bottom side, a front end, a back end, a first lateral edge and a second lateral edge. The front end is upturned. One of foot engaging member is positioned nearer to the front end and one foot engaging member is positioned nearer to the back end. Each of the foot engaging members comprises a first rail and a second rail each attached to the top side. The first rail is positioned adjacent to the first lateral edge and the second rail is positioned adjacent to the second lateral edge. The first and second rails are orientated parallel to each other. A plate is positioned on the top side and extends between and engages the first and second rails. The plate is selectively slidable between proximal and distal ends of the first and second rails with respect to the front end to allow selective positioning of the plate on the top side. A foot covering is couplable to the plate to releasably secure a person's foot to the plate. A resistance apparatus engages the plate to increase or decrease a frictional force between the first and second rails and the plate to selectively alter ease of movement of the relative to the first and second rails.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
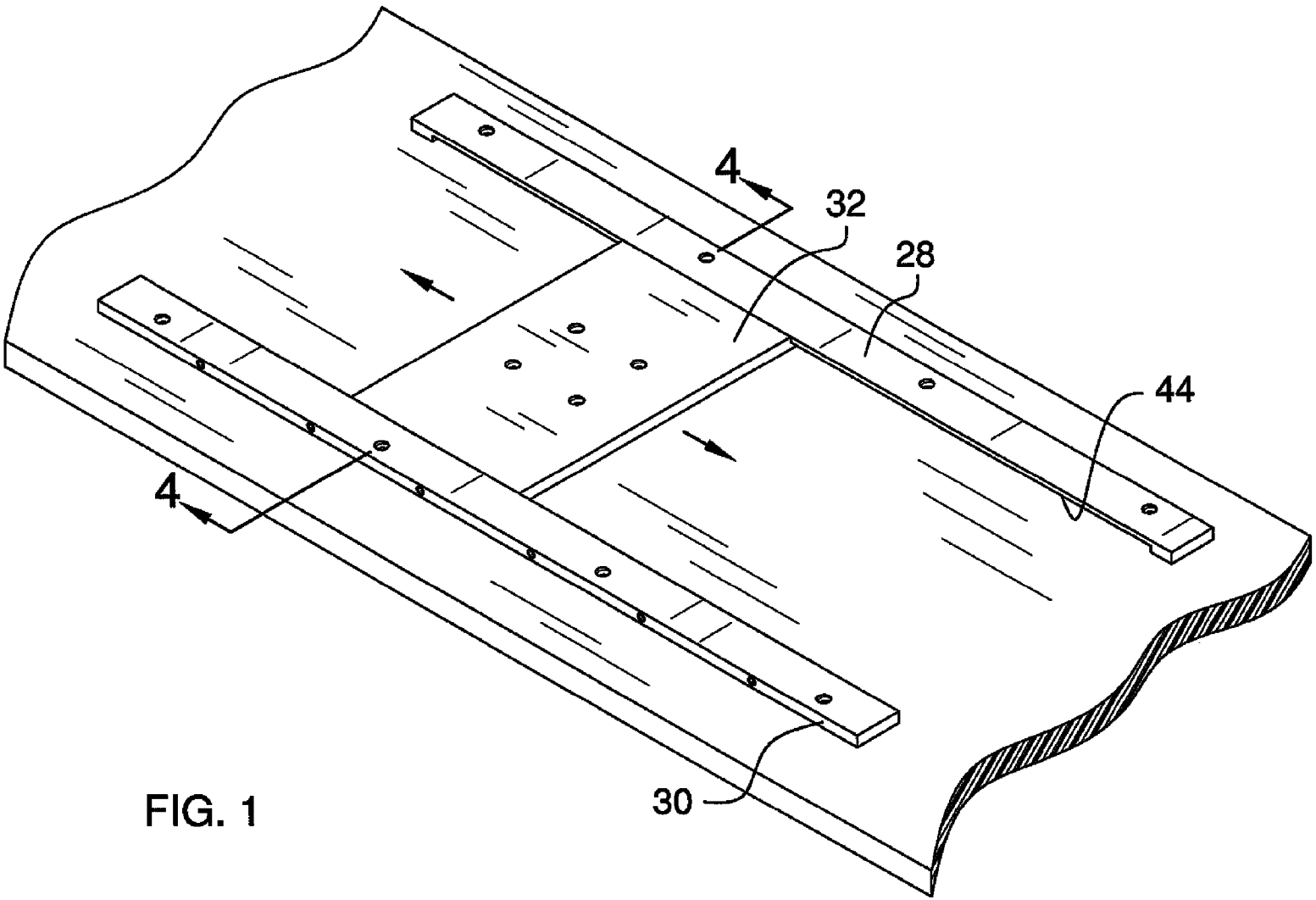
FIG. 1 is a broken top perspective view of a snowboard assembly according to an embodiment of the disclosure.
Figure 2:
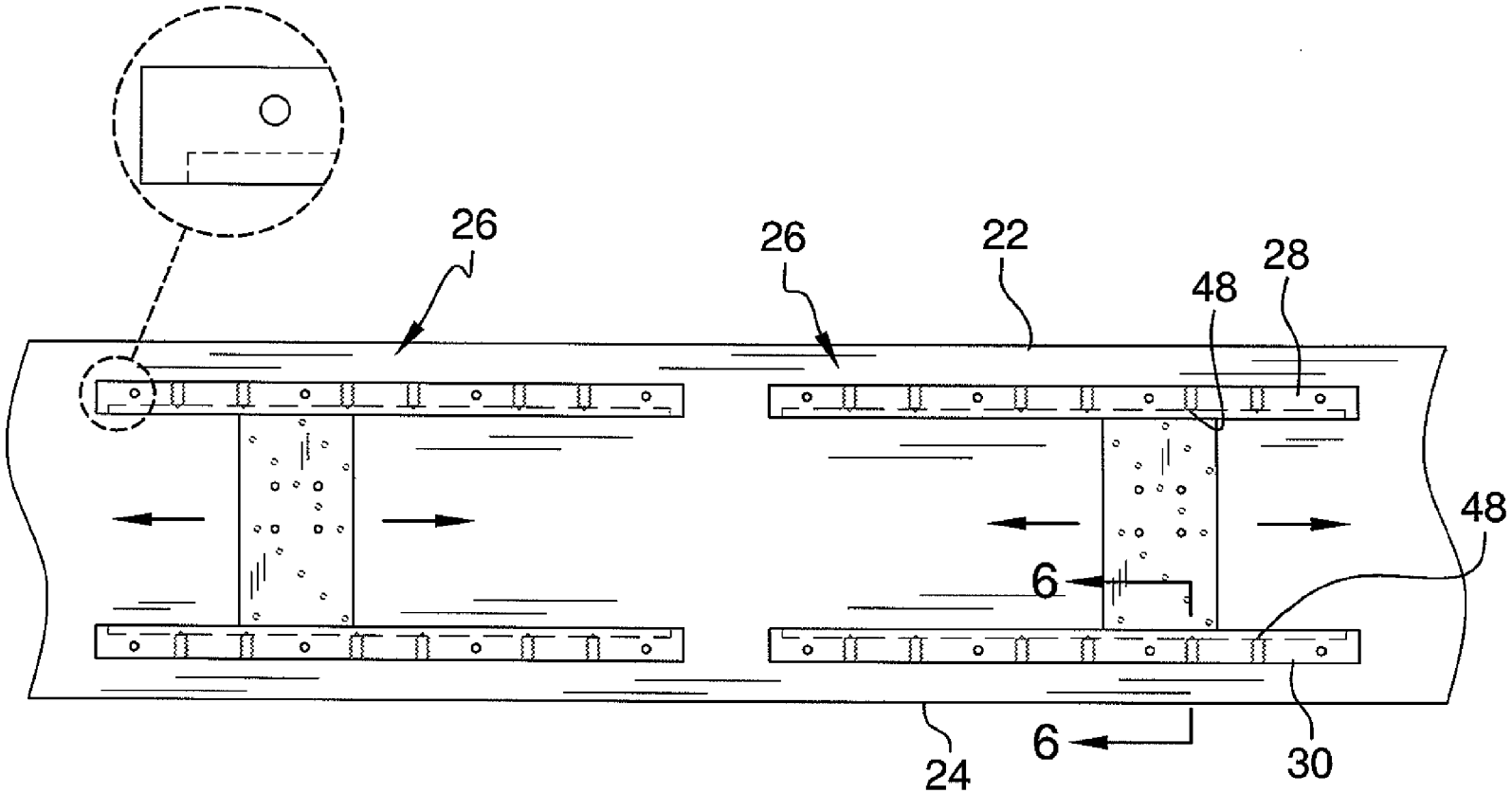
FIG. 2 is a top broken view of an embodiment of the disclosure.
Figure 3:
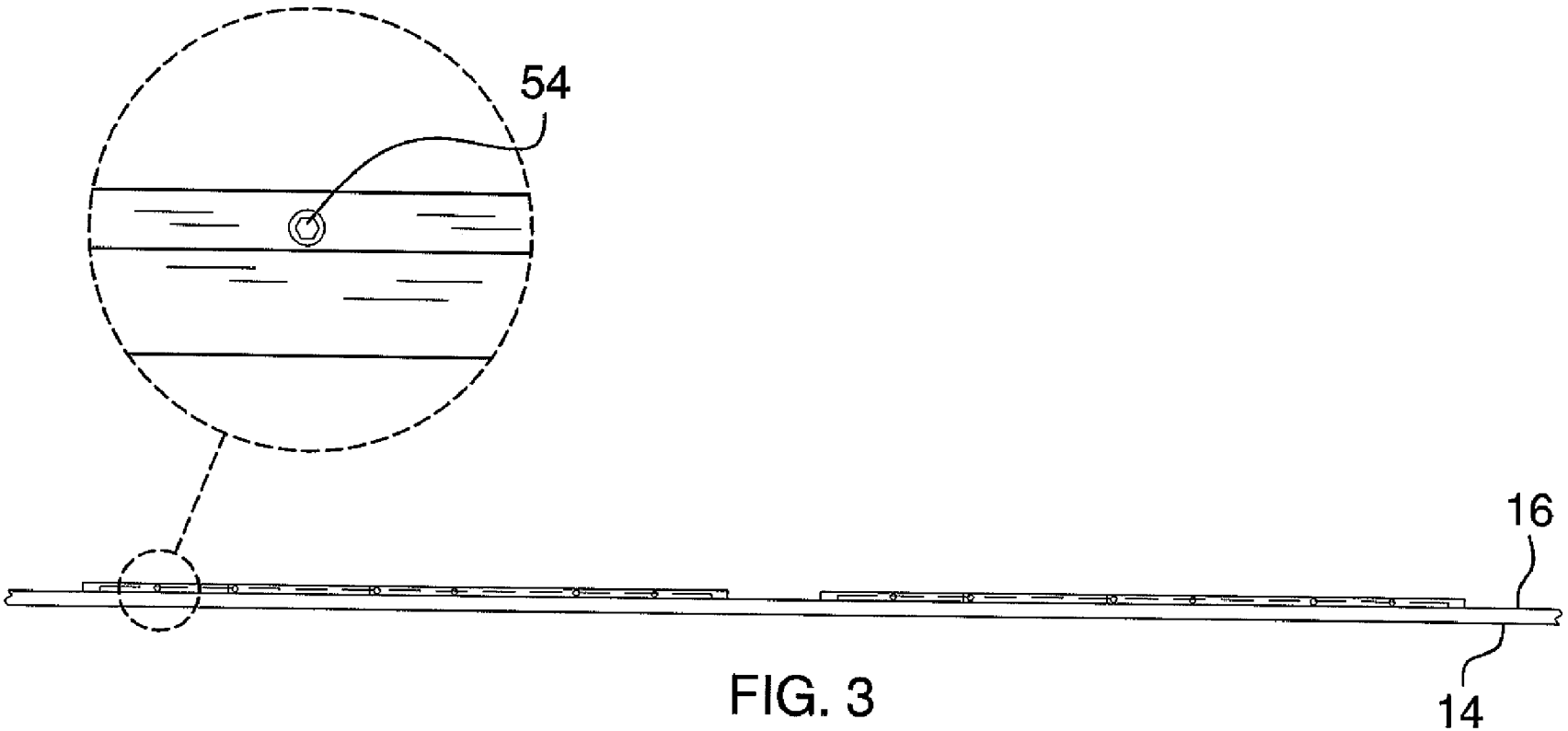
FIG. 3 is a side view of an embodiment of the disclosure.
Figure 4:
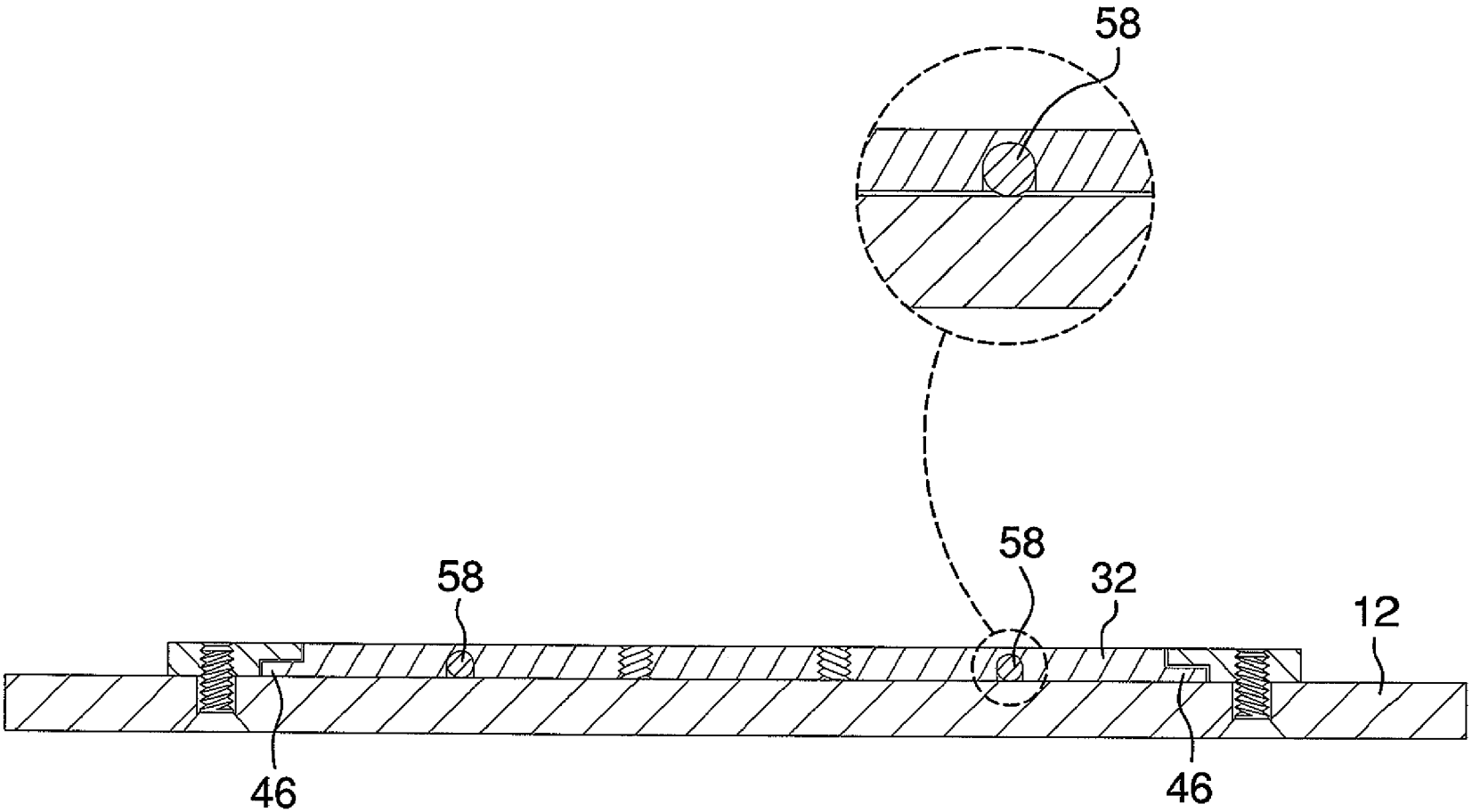
FIG. 4 is a cross-sectional view taken along line 4-4 of FIG. 1 of an embodiment of the disclosure.
Figure 5:
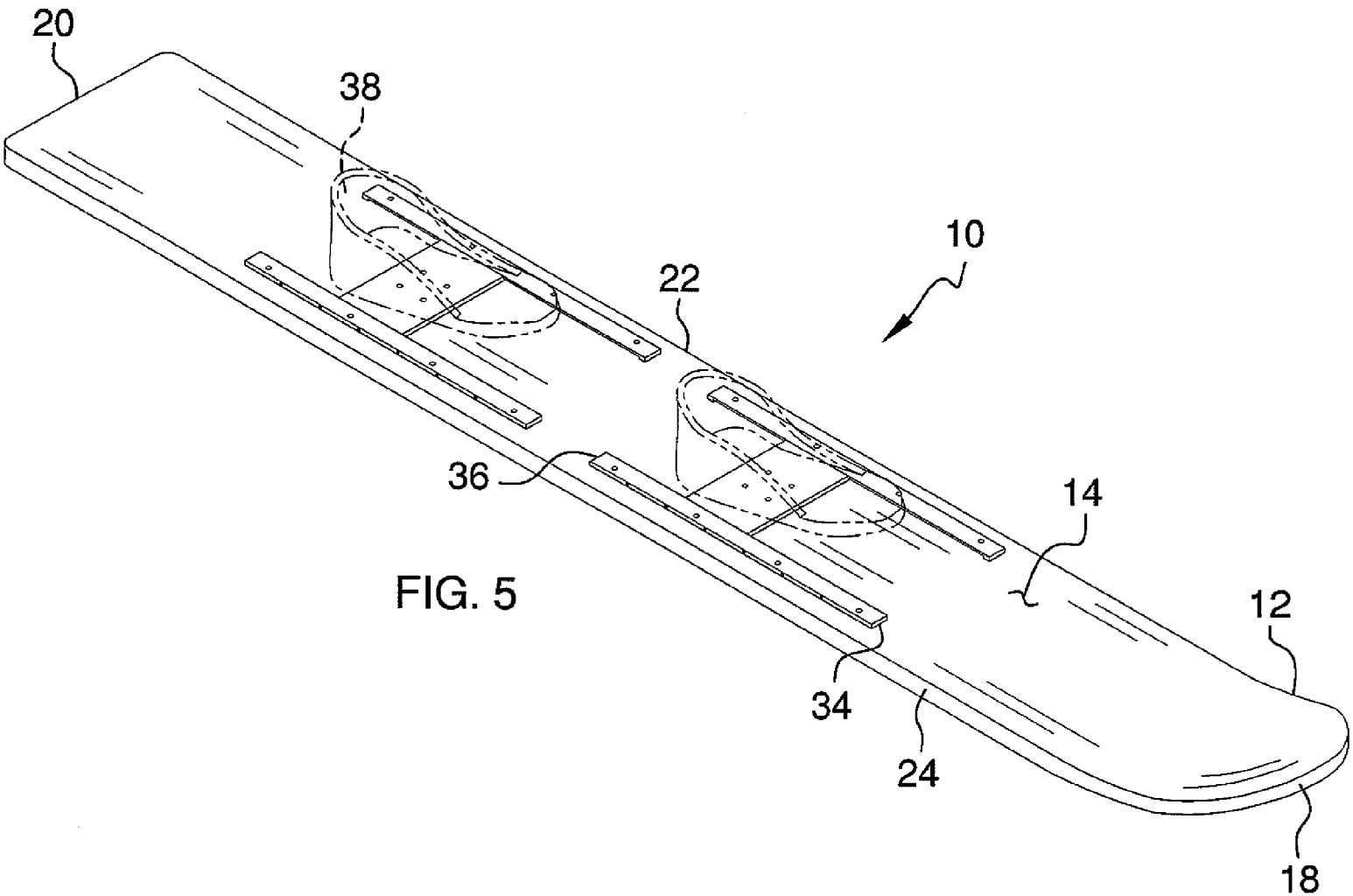
FIG. 5 is a top perspective view of an embodiment of the disclosure.
Figure 6:
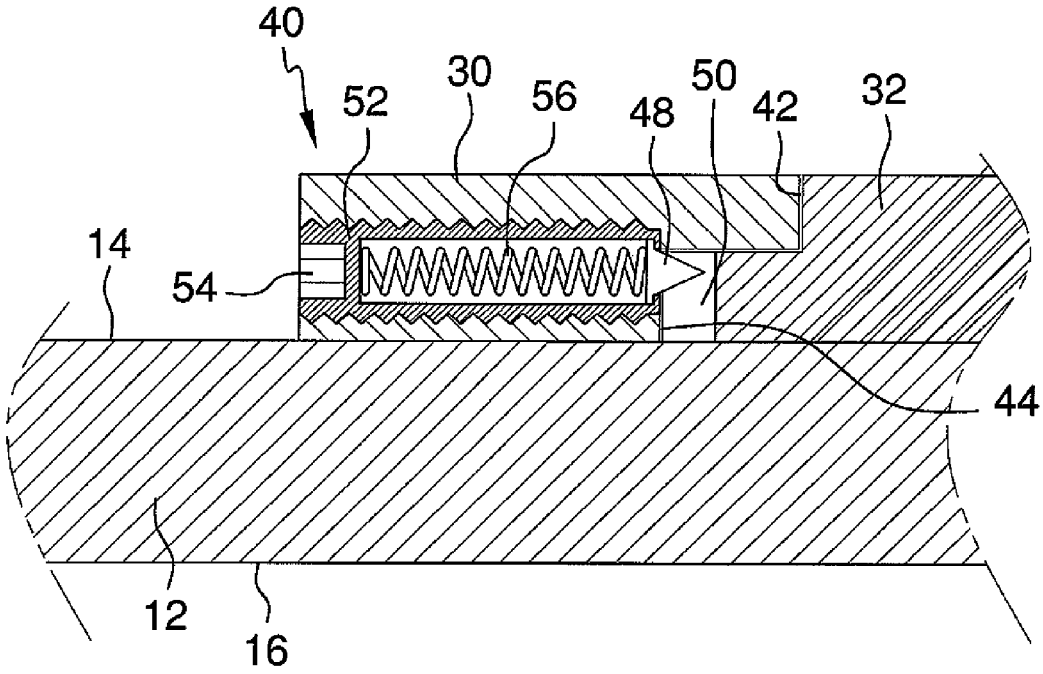
FIG. 6 is a cross-sectional view of an embodiment of the disclosure taken along line 6-6 of FIG. 2.
Figure 7:
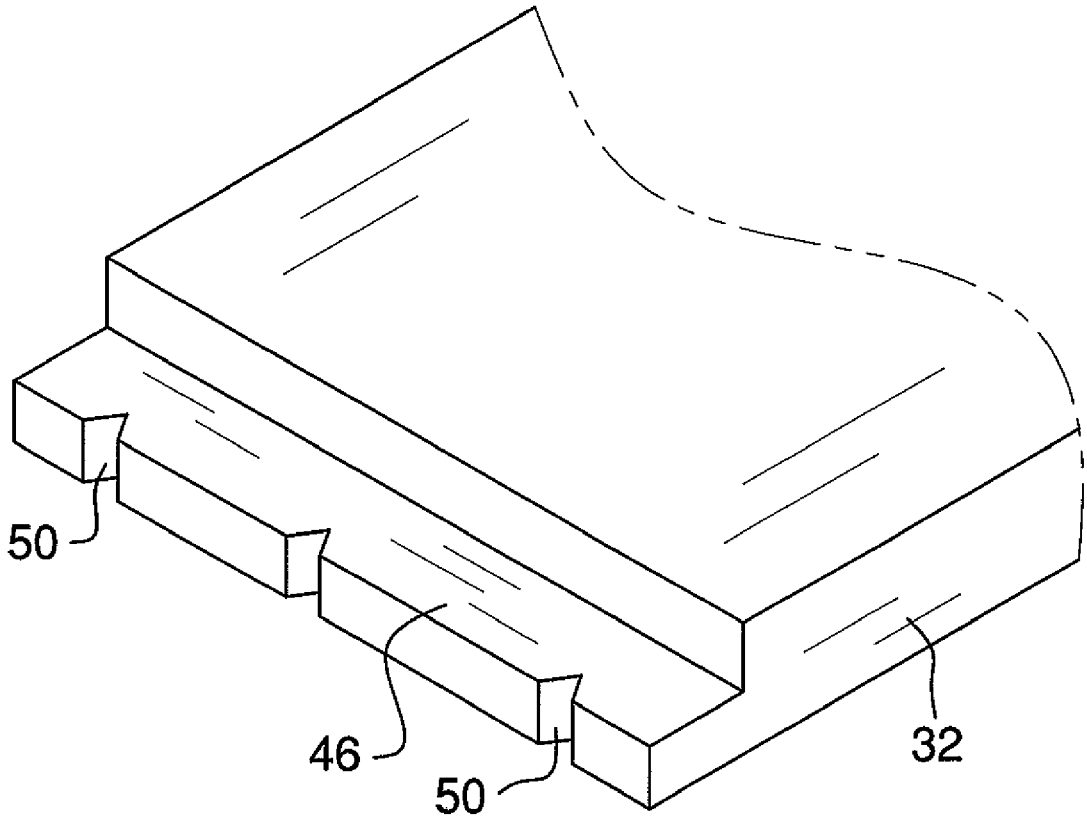
FIG. 7 is a broken side perspective view of a plate and flange of an embodiment of the disclosure.

With reference now to the drawings, and in particular to FIGS. 1 through 7 thereof, a new snowboard device embodying the principles and concepts of an embodiment of the disclosure and generally designated by the reference numeral 10 will be described.

As best illustrated in FIGS. 1 through 7, the snowboard assembly 10 generally comprises an elongated panel 12 that has a top side 14, a bottom side 16, a front end 18, a back end 20, a first lateral edge 22 and a second lateral edge 24. The front end 18 is upturned. The panel 12 may have any conventional shape and material construction used for snowboards.

A pair of foot engaging members 26 is provided. One of the foot engaging members 26 is positioned nearer to the front end 18 and one of the foot engaging members 26 is positioned nearer to the back end 20. Each of the foot engaging members 26 comprises a first rail 28 and a second rail 30 each being attached to the top side 14. The first rail 28 is positioned adjacent to the first lateral edge 22 and the second rail 30 is positioned adjacent to the second lateral edge 24. The first 28 and second 30 rails are orientated parallel to each other. A plate 32 is positioned on the top side 14 and extends between and engages the first 28 and second 30 rails. The plate 32 is selectively slidable between proximal 34 and distal 36 ends of the first 28 and second 30 rails with respect to the front end 18 to allow selective positioning of the plate 32 on the top side 14. A foot covering is couplable to the plate 32 to releasably secure a person's foot to the plate 32. More particularly, binding members 38 are attachable to the plate 32 and the boots or other foot coverings are then bound to the plate 32 with the binding members. However, any conventional binding means typically used with snowboard may be utilized. A resistance apparatus 40 engages the plate 32 to increase or decrease a frictional force between the first 28 and second 30 rails and the plate 32 to selectively alter ease of movement of the relative to the first 28 and second 30 rails. This allows a person, while performing snowboarding maneuvers such as jumps, to selectively move their feet with respect to the front end 18 to allow better control for particular types of activities. The resistance apparatus 40 prevents the plate 32 from sliding too easily along the panel 12 which would make the snowboard impossible to control.

Each of the first 28 and second rails 30 includes an inner face 42 facing each other. The inner face 42 of each of the first 28 and second 30 rails has an elongated slot 44 therein which terminates before the distal 36 and proximal 34 ends of the first 28 and second 30 rails. The plate 32 has a pair of side flanges 46 positioned opposite of each other. Each slot 44 of the first 28 and second 30 rails has one of the flanges 46 positioned therein to engage the plate with the first 28 and second 30 rails. The resistance apparatus 40 includes a plurality of detents 48. Each of the first 28 and second 30 rails has at least two of the detents 48 mounted therein. Each of the detents 48 extends into an associated slot 44 of the first 28 and second 30 rails and frictionally engages one of the flanges 46. The flanges 46 each have an outer edge having a plurality of notches 50 therein for receiving the detents 48. The detents 48 are biased toward the flanges 46 and into respective ones of the notches 50. The detents 48 are selectively movable toward or away from the plate 32 to adjust friction between the detents 48 and the flanges 46. More particularly, the detents 48 are mounted within cylinders 52 threadably coupled to the first 28 and second 30 rails which include heads 54 for rotating the cylinders 52. A spring 56 biases the detents 48 out of the cylinders 52 and toward the flanges 46.

A plurality of ball bearings 58 is rotatably mounted to the plate 32 and is positioned between the plate 32 and the top side 14 to reduce friction between the plate 32 and the panel 12. The plate 32 rides on the ball bearings 58 to ensure that the only tactile friction in the assembly is found at the resistance apparatus 40.

In use, the assembly 10 is used in a conventional manner to be bound to a person's feet for snowboarding purposes. However, the plates 32 of the foot engaging members 26 allow the user to move their feet on the panel 12 to assist them in better controlling of the panel 12 during particular ground and aerial maneuvers.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A snowboard assembly comprising:

an elongated panel having a top side, a bottom side, a front end, a back end, a first lateral edge and a second lateral edge, said front end being upturned;

a pair of foot engaging members, one of said foot engaging members being positioned nearer to said front end and one of said foot engaging members being positioned nearer to said back end, each of said foot engaging members comprising:

a first rail and a second rail each being attached to said top side, said first rail positioned adjacent to said first lateral edge and said second rail positioned adjacent to said second lateral edge, said first and second rails being orientated parallel to each other;

a plate being positioned on said top side and extending between and engaging said first and second rails, said plate being selectively slidable between proximal and distal ends of said first and second rails with respect to said front end to allow selective positioning of said plate on said top side, wherein a foot covering is couplable to said plate to releasably secure a person's foot to said plate; and a resistance apparatus engaging said plate to increase or decrease a frictional force between said first and second rails and said plate to selectively alter ease of movement of said plate relative to said first and second rails;

each of said first and second rails including an inner face facing each other, said inner face of each of said first and second rails having an elongated slot therein;

said plate having a pair of side flanges positioned opposite of each other, each slot of said first and second rails having one of said flanges positioned therein to engage said plate with said first and second; and said resistance apparatus including a plurality of detents, each of said first and second rails having at least two of said detents mounted therein, each of said detents extending into an associated slot of said first and second rails and frictionally engaging one of said flanges.

2. The assembly according to claim 1, wherein each of said foot engaging members further comprises:

said flanges each having an outer edge having a plurality of notches therein for receiving said detents.

3. The assembly according to claim 2, wherein each of said foot engaging members further comprises:

said detents being biased toward said flanges and into respective ones of said notches.

4. The assembly according to claim 3, wherein each of said foot engaging members further comprises:

said detents being threadably coupled to a corresponding one of said first and second rails to be selectively movable toward or away from said plate to adjust friction between said detents and said flanges.

5. The assembly according to claim 1, wherein each of said foot engaging members further comprises:

said detents being threadably coupled to a corresponding one of said first and second rails to be selectively movable toward or away from said plate to adjust friction between said detents and said flanges.

6. The assembly according to claim 5, wherein each of said foot engaging members further comprises:

a plurality of ball bearings being rotatably mounted to said plate and being positioned between said plate and said top side to reduce friction between said plate and said panel.

7. The assembly according to claim 1, wherein each of said foot engaging members further comprises:

a plurality of ball bearings being rotatably mounted to said plate and being positioned between said plate and said top side to reduce friction between said plate and said panel.

8. A snowboard assembly comprising:

an elongated panel having a top side, a bottom side, a front end, a back end, a first lateral edge and a second lateral edge, said front end being upturned;

a pair of foot engaging members, one of said foot engaging members being positioned nearer to said front end and one of said foot engaging members being positioned nearer to said back end, each of said foot engaging members comprising:

a first rail and a second rail each being attached to said top side, said first rail positioned adjacent to said first lateral edge and said second rail positioned adjacent to said second lateral edge, said first and second rails being orientated parallel to each other;

a plate being positioned on said top side and extending between and engaging said first and second rails, said plate being selectively slidable between proximal and distal ends of said first and second rails with respect to said front end to allow selective positioning of said plate on said top side, wherein a foot covering is couplable to said plate to releasably secure a person's foot to said plate;

a resistance apparatus engaging said plate to increase or decrease a frictional force between said first and second rails and said plate to selectively alter ease of movement of said plate relative to said first and second rails;

each of said first and second rails including an inner face facing each other, said inner face of each of said first and second rails having an elongated slot therein;

said plate having a pair of side flanges positioned opposite of each other, each slot of said first and second rails having one of said flanges positioned therein to engage said plate with said first and second rails;

said resistance apparatus including a plurality of detents, each of said first and second rails having at least two of said detents mounted therein, each of said detents extending into an associated slot of said first and second rails and frictionally engaging one of said flanges, said flanges each having an outer edge having a plurality of notches therein for receiving said detents, said detents being biased toward said flanges and into respective ones of said notches, said detents being selectively movable toward or away from said plate to adjust friction between said detents and said flanges; and a plurality of ball bearings being rotatably mounted to said plate and being positioned between said plate and said top side to reduce friction between said plate and said panel.

9. A snowboard assembly comprising:

an elongated panel having a top side, a bottom side, a front end, a back end, a first lateral edge and a second lateral edge, said front end being upturned;

a pair of foot engaging members, one of said foot engaging members being positioned nearer to said front end and one of said foot engaging members being positioned nearer to said back end, each of said foot engaging members comprising:

a first rail and a second rail each being attached to said top side, said first rail positioned adjacent to said first lateral edge and said second rail positioned adjacent to said second lateral edge, said first and second rails being orientated parallel to each other;

a plate being positioned on said top side and extending between and engaging said first and second rails, said plate being selectively slidable between proximal and distal ends of said first and second rails with respect to said front end to allow selective positioning of said plate on said top side, wherein a foot covering is couplable to said plate to releasably secure a person's foot to said plate;

a resistance apparatus engaging said plate to increase or decrease a frictional force between said first and second rails and said plate to selectively alter ease of movement of said plate relative to said first and second rails; and a plurality of ball bearings being rotatably mounted to said plate and being positioned between said plate and said top side to reduce friction between said plate and said panel.

10. The assembly according to claim 9, wherein each of said foot engaging members further comprises:

each of said first and second rails including an inner face facing each other, said inner face of each of said first and second rails having an elongated slot therein; and said plate having a pair of side flanges positioned opposite of each other, each slot of said first and second rails having one of said flanges positioned therein to engage said plate with said first and second rails.

11. The assembly according to claim 10, wherein each of said foot engaging members further comprises:

said resistance apparatus including a plurality of detents, each of said first and second rails having at least two of said detents mounted therein, each of said detents extending into an associated slot of said first and second rails and frictionally engaging one of said flanges.

12. The assembly according to claim 11, wherein each of said foot engaging members further comprises:

said flanges each having an outer edge having a plurality of notches therein for receiving said detents.

13. The assembly according to claim 12, wherein each of said foot engaging members further comprises:

said detents being biased toward said flanges and into respective ones of said notches.

14. The assembly according to claim 13, wherein each of said foot engaging members further comprises:

said detents being threadably coupled to a corresponding one of said first and second rails to be selectively movable toward or away from said plate to adjust friction between said detents and said flanges.

15. The assembly according to claim 11, wherein each of said foot engaging members further comprises:

said detents being threadably coupled to a corresponding one of said first and second rails to be selectively movable toward or away from said plate to adjust friction between said detents and said flanges.

16. The assembly according to claim 15, wherein each of said foot engaging members further comprises:

a plurality of ball bearings being rotatably mounted to said plate and being positioned between said plate and said top side to reduce friction between said plate and said panel.

* * * * *